United States Patent [19]

Davis et al.

[11] Patent Number: 4,599,088

[45] Date of Patent: Jul. 8, 1986

[54] CLEAR STABLE GASOLINE-ALCOHOL-WATER MOTOR FUEL COMPOSITION

[75] Inventors: Marshall E. Davis, Poughkeepsie; Rodney L. Sung, Fishkill, both of N.Y.

[73] Assignee: Texaco Inc., White Plains, N.Y.

[21] Appl. No.: 645,642

[22] Filed: Aug. 30, 1984

[51] Int. Cl.[4] ..... C10L 1/32

[52] U.S. Cl. ..... 44/51; 44/56; 252/351; 252/357

[58] Field of Search ..... 44/56, 51; 252/357, 252/351

[56] References Cited

U.S. PATENT DOCUMENTS

| | | | |
|---|---|---|---|
| 2,920,948 | 1/1960 | Weeks | 44/56 |
| 3,822,119 | 7/1974 | Frech et al. | 44/56 |
| 3,876,391 | 4/1975 | McCoy et al. | 44/51 |
| 3,988,122 | 10/1976 | Rosenthal et al. | 44/56 |
| 4,154,580 | 5/1979 | Landis | 44/56 |
| 4,384,872 | 5/1983 | Kester et al. | 44/56 |
| 4,398,920 | 8/1983 | Guibet et al. | 44/56 |
| 4,410,333 | 10/1983 | Fujimoto | 44/56 |
| 4,410,334 | 10/1983 | Parkinson | 44/56 |

*Primary Examiner*—William R. Dixon, Jr.
*Assistant Examiner*—Margaret B. Medley
*Attorney, Agent, or Firm*—Robert A. Kulason; James J. O'Loughlin; Albert Brent

[57] ABSTRACT

A clear stable motor fuel composition having an improved octane rating which comprises about 2.0 to 10.0 volume percent of an alcohol selected from the group consisting of methanol, ethanol, tertiary butyl alcohol, isopropanol, and mixtures thereof; about 0.10 to 0.50 weight percent water; about 0.10 to 3.0 weight percent of a nonionic adduct of alkylphenol and ethylene oxide surfactant having 9 to 24 carbon atoms in the alkyl group and 6–10.0 ethylene oxide groups; and the remainder of said clear stable motor fuel composition is gasoline.

17 Claims, No Drawings

CLEAR STABLE GASOLINE-ALCOHOL-WATER MOTOR FUEL COMPOSITION

FIELD OF THE INVENTION

This invention relates to fuels for internal combustion engines and more particularly to a novel clear stable gasoline-alcohol-water motor fuel composition.

The use of aliphatic alcohols such as methanol and ethanol to extend gasoline fuels while imparting a higher octane rating to the gasoline has been long attempted. Alcohol-gasoline blends have a low tolerance for water that is encountered in the blending and distribution systems. Methanol-gasoline blends are much less water tolerant than ethanol-gasoline blends. Unstable hazy blends may result when water is present in such systems. Hazy gasolines are unacceptable by the public since they may indicate that something is wrong with the product. For example, the fuel may be contaminated. Further, phase separation may occur with water separating out and contributing to corrosion problems and motor starting difficulties.

On the other hand, it has been recognized that some water in the gasoline is desirable since the presence of water will reduce the Octane Requirement Increase (ORI), and will increase the Octane Rating (OR). Advantageously, by the subject invention gasoline may be extended and its performance improved by the addition of alcohols and water without producing haze and separation of the constituents.

U.S. Pat. No. 3,876,391 discloses clear motor fuel microemulsions comprising gasoline, water, two different surfactants and a water soluble and insufficiently gasoline soluble additive. No alcohol is present. U.S. Pat. No. 4,384,872 discloses a motor fuel composition comprising gasoline, alcohol and an interfacial modifying agent. No water is present.

SUMMARY OF THE INVENTION

In accordance with the invention there is provided a clear stable gasoline-alcohol-water motor fuel composition comprising about 2.0 to 10.0 volume percent of an alcohol selected from the group consisting of methanol, ethanol, tertiary butyl alcohol, isopropanol, and mixtures thereof; about 0.10 to 0.5 weight percent water; about 0.10 to 3.0 weight percent of a nonionic adduct of an alkylphenol having 9 to 24 carbon atoms in the alkyl group, the ethylene oxide having 6–10.0 ethylene oxide groups; and the remainder gasoline. In a preferable embodiment the clear stable motor fuel composition comprises a mixture of an alcohol selected from the group consisting of methanol in the amount of about 2.0 to 5.0 volume percent, ethanol in the amount of about 2.0 to 10.0 volume percent, and mixtures thereof in the amount of about 3.0 to 9.0 volume percent, about 2.0 to 10 volume percent of a cosolvent alcohol selected from the group consisting of tertiary butyl alcohol, isopropanol, and mixtures thereof; water to provide a total water concentration of about 0.1 to 0.5 weight percent; about 0.10 to 3.0 weight percent of the aforesaid surfactant; and the balance comprising the base fuel gasoline. Preferably, the volumetric ratio of tertiary butyl alcohol and/or isopropanol to methanol and/or ethanol in the subject clear stable motor fuel composition is in the range of about 0.3 to 3.0, such as about 0.5 to 2.0.

This invention also provides a process for operating an internal combustion engine, supplying thereto, and combusting therein the above motor fuel composition.

DISCLOSURE OF THE INVENTION

The subject invention deals with clear stable motor fuel compositions comprising gasoline, alcohol, water and a surfactant. The surfactant more specifically comprises certain nonionic adducts of an alkylphenol and ethylene oxide. A low dosage e.g. about two weight percent or less of the surfactant will solubilize the water and form a microemulsion. The microemulsion is of the "water-in-petroleum" type in which the average particle diameter of the dispersed phase is about 0.1 micron or smaller. Clear stable gasoline-alcohol-water motor fuel compositions having upgraded performance characteristics are thereby provided.

The stable gasoline-alcohol-water motor fuel composition comprises about 2.0 to 10.0 volume percent (basis motor fuel composition) of the alcohol selected from the group consisting of methanol, ethanol, tertiary butyl alcohol, isopropanol and mixtures thereof; about 0.10 to 0.5 weight percent (wt. %) water (basis motor fuel composition); about 0.10 to 3.0 wt. % (basis motor fuel composition), such as about 1.0 to 2.04 wt. % of a surfactant consisting of a nonionic adduct of an alkyphenol having 9 to 24 carbon atoms in the alkyl group, and ethylene oxide having 6–10.0 ethylene oxide groups; and the remainder is a gasoline base fuel. Preferably, the volumetric ratio of tertiary butyl alcohol and/or isopropanol to methanol and/or ethanol in the subject clear stable motor fuel composition is in the range of about 0.3 to 3.0, such as about 0.5 to 2.0.

In one embodiment, the subject clear stable motor fuel composition may be prepared as follows:

Mixture A is prepared by mixing together an alcohol selected from the group consisting of methanol in the amount of about 2.0 to 5.0 volume percent, such 2.70 to 4.75 volume percent, ethanol in the amount of about 2.0 to 10.0 volume percent such as about 4.75 to 9.0 volume percent, and mixtures thereof in the amount of about 3.0 to 9.0 volume percent; about 2 to 10 volume percent, such as about 4.75 to 6.3 volume percent of a cosolvent alcohol selected from the group consisting of tertiary butyl alcohol, isopropanol, and mixtures thereof; and water to provide a total water concentration of about 0.1 to 0.5 weight percent (basis motor fuel composition). A hazy motor fuel composition is obtained when Mixture A and the base fuel gasoline, substantially comprising the remainder of the motor fuel composition, are mixed together. Further, about 0.10 to 3.0 weight percent (basis motor fuel composition) of a surfactant to be more fully described is added during the blending of Mixture A with the gasoline. Agitation is continued until the clear stable gasoline-alcohol-water motor fuel composition of this invention is made. The clear dispersion produced is a microemulsion.

The aforesaid improved surfactant which is used in the subject clear stable motor fuel composition comprises the nonionic adduct of alkylphenol and ethylene oxide having the structural formula I as follows:

$$R(CH_2CH_2O)_xH \qquad \text{I}$$

wherein: R is an alkylphenol group where the alkyl group has 9 to 24 carbons, such as 10 to 12 carbons and x is an integer from 6–10 such as 7–9.5, say 7–8.

Any gasoline suitable for a spark-ignited internal combustion engine can be extended and its octane rating increased by being blended with water and a specific alcohol or mixture of alcohols in accordance with the practice of this invention. Clear stable gasoline-alcohol-water motor fuel compositions are thereby produced. In general, the base fuel will consist of a mixture of hydrocarbons in the gasoline boiling range i.e., boiling from about 75° to 450° F. The hydrocarbon components may consist of paraffinic naphthenic, aromatic and olefinic hydrocarbons. This gasoline can be obtained naturally or it may be produced by thermal or catalytic cracking and/or reforming of petroleum hydrocarbons. The base fuel will generally have a Research Octane Number above 85 and up to about 102 with the preferred range being from about 90 to 100.

In most cases, water from an external source will be introduced into the motor fuel composition to supplement any water that may be dissolved in the alcohol and/or gasoline. Sources of water include purified deionized water, and bottom phase water e.g. process water that sinks to the bottom of a gravity separation tank containing gasoline.

In another embodiment, gasoline contaminated with water may be processed into an upgraded clear stable motor fuel. In such case, the gasoline-water mixture is mixed with a mixture of the aforesaid alcohols, any additional water, and said nonionic adduct of alkyl phenol and ethylene oxide having the previously described formula I. The amount of each constituent is the same as that previously described in the preferred embodiment. Agitation is continued until a clear dispersion is produced.

Advantages of the present invention are illustrated by the following specific examples. These examples are set forth for purpose of illustration and should not be construed as limiting the invention.

EXAMPLES

Clear stable gasoline-alcohol-water fuel Composition No. 1 was made by mixing together 50 parts by volume of clear unleaded gasoline (base fuel) and 50 parts by volume of clear gasoline with the addition of 4000 parts per million of water, 2.7 volume percent of methanol, and 6.3 volume percent of tertiary butyl alcohol to produce a hazy fuel composition. A surfactant (Formula I) comprising nonionic adducts of a nonylphenol and ethylene oxide having 1 to 9.5. ethylene oxide groups were then added dropwise at room temperature (70°-75° F.) to said hazy fuel composition until the mixture was clear. The fuel appearance is shown in Table I.

TABLE I

| FUEL APPEARANCE | | | | | |
|---|---|---|---|---|---|
| Number of Ethylene Oxide Groups in Formula I | 1.0 | 4.0 | 6.0 | 6.0 | 9.5 |
| Ml of the aforesaid Surfactant to get a Clear Blend | 5.0 | 2.0 | 0.8 | 1.0 | 1.0 |
| Temperature | | | | | |
| 70°-75° F. | Hazy | Clear | Clear | Clear | Clear |
| 35° F. | — | Clear | Hazy | Clear | Clear |

From Table I it may be shown that preferably the value for x in Formula I should be in the range of 6-9.5, and a specific amount of surfactant is required to produce clear stable motor fuel compositions comprising alcohol-gasoline-water.

Further Examples of various formulations of the subject clear stable gasoline-alcohol-water motor fuel compositions are shown in Table II.

TABLE II

CLEAR STABLE GASOLINE-ALCOHOL-WATER MOTOR FUELS

| | EXAMPLE | | | | | |
|---|---|---|---|---|---|---|
| | 2 | | 3 | | 4 | |
| INGREDIENT | Broad | Pref. | Broad | Pref. | Broad | Pref. |
| Methanol, Vol. % | 2.0-5.0 | 2.7-4.75 | 2.0-5.0 | 2.7-4.75 | — | — |
| and/or | | | | | | |
| Ethanol, Vol. % | 2.0-10.0 | 9.0-10.0 | 2.0-10.0 | 4.75-6.3 | 5.0-10.0 | |
| Tertiary Butyl Alcohol, Vol. % | 2.0-10.0 | 4.75-6.3 | — | — | 4.0-7.0 | 9.0-10.0 |
| and/or | | | | | | |
| Polypropanol, Vol. % | 2.0-10.0 | 4.75-6.3 | — | — | 4.0-7.0 | 9.0-10.0 |
| Water, Wt. % | 0.1-0.5 | 0.3-0.4 | 0.1-0.5 | 0.3-0.4 | 0.1-0.5 | 0.3-0.3 |
| Surfactant, Formula I Wt. % | 0.1-3.0 | 0.7-2.04 | 0.1-3.0 | 0.7-2.04 | 0.1-3.0 | 0.7-2.04 |
| Gasoline, Vol. % | Remainder | | Remainder | | Remainder | |

| | EXAMPLE | | | | | |
|---|---|---|---|---|---|---|
| | 5 | | 6 | | 7 | |
| INGREDIENT | Broad | Pref. | Broad | Pref. | Broad | Pref. |
| Methanol, Vol. % | — | — | 2.0-5.0 | 2.7-4.75 | — | — |
| and/or | | | | | | |
| Ethanol, Vol. % | 2.0-10.0 | 5.0-10.0 | — | — | — | — |
| Tertiary Butyl Alcohol, Vol. % | — | — | 2.0-10.0 | 4.75-6.3 | 5.0-10 | 4.7-7.0 |
| and/or | | | | | | |
| Polypropanol, Vol. % | — | — | 2.0-10.0 | 4.0-6.0 | 5.0-10 | 4.7-7.0 |
| Water, Wt. % | 0.1-0.5 | 0.3-0.4 | 0.1-0.5 | 0.3-0.4 | 0.1-0.5 | 0.3-0.4 |
| Surfactant, Formula I Wt. % | 0.1-3.0 | 0.7-2.04 | 1-3.0 | 0.7-2.04 | 0.1-3.0 | 0.7-2.04 |
| Gasoline, Vol. % | Remainder | | Remainder | | Remainder | |

Although this invention has been illustrated by reference to specific embodiments, it will be apparent to those skilled in the art that various changes and modifications may be made which clearly fall within the scope of this invention.

We claim:

1. A clear stable motor fuel composition of the "water-in-petroleum" type microemulsion in which the average particle diameter of the dispersed phase is about 0.1 micron or smaller, said motor fuel composition comprising a mixture based on the final motor fuel composition of about 2.0 to 10.0 volume percent of an alcohol selected from the group consisting of methanol, ethanol, tertiary butyl alcohol, isopropanol, and mixtures thereof; about 0.10 to 0.50 weight percent water; about 0.10 to 3.0 weight percent of a nonionic adduct of alkylphenol and ethylene oxide surfactant having the structural Formula I, as follows:

$$R(CH_2CH_2O)_xH \quad \text{I}$$

wherein: R is an alkylphenol group where the alkyl group has 9–24 carbon atoms; and x is an integer from 6–10.0; and the balance of said clear stable motor fuel composition comprises gasoline.

2. The motor fuel composition of claim 1 wherein the weight ratio of tertiary butyl alcohol and/or isopropanol to methanol and/or ethanol is in the range of about 0.3 to 3.0.

3. The motor fuel composition of claim 1 wherein the nonionic adduct of alkylphenol and ethylene oxide is about 0.10 to 2.04 weight percent of the total motor fuel composition.

4. The motor fuel composition of claim 1 wherein the water is about 0.30 to 0.40 weight percent of the total motor fuel composition.

5. The motor fuel composition of claim 1 where in structural Formula I the alkyl group in R has 10 to 12 carbon atoms and x is an integer from 7–8.

6. The motor fuel composition of claim 1 where in structural Formula I the alkyl group in R has 10 to 12 carbon atoms and x is an integer from 7–9.5.

7. A clear stable motor fuel composition of the "water-in-petroleum" type microemulsion in which the average particle diameter of the dispersed phase is about 0.1 micron or smaller, said motor fuel composition comprising a mixture based on the final motor fuel composition of an alcohol selected from the group consisting of methanol in the amount of about 2.0 to 5.0 vol. %, ethanol in the amount of about 2.0 to 10.0 vol. %, and mixtures thereof in the amount of about 3 to 9.0 vol. %; about 2.0 to 10 vol. % of a cosolvent alcohol selected from the group consisting of tertiary butyl alcohol, isopropanol, and mixtures thereof; water to provide a total water concentration of about 0.1 to 0.5 wt. %; about 0.10 to 3.0 weight percent of a nonionic adduct of alkylphenol and ethylene oxide surfactant having the structural Formula I, as follows:

$$R(CH_2CH_2O)_xH \quad \text{I}$$

wherein: R is an alkylphenol group where the alkylphenol group where the alkyl group has 9–24 carbon atoms; and x is an integer from 6–10.0; and the balance of said clear stable motor fuel composition is gasoline. atoms and x is an integer from 7–8.

8. The motor fuel composition of claim 7 wherein the weight ratio of tertiary butyl alcohol and/or isopropanol to methanol and/or ethanol is in the range of about 0.3 to 3.0.

9. A clear stable motor fuel composition of the "water-in-petroleum" type microemulsion in which the average particle diameter of the dispersed phase is about 0.1 micron or smaller, said motor fuel composition comprising a mixture based on the final motor fuel composition of: about 2.0–5.0 vol. % of methanol; about 2.0–10.0 vol. % of ethanol; about 0.1–0.5 wt. % of water; about 0.10 to 3.0 wt. % of a nonionic adduct of alkylphenol and ethylene oxide surfactant having structural Formula I, as follows:

$$R(CH_2CH_2O)_xH \quad \text{I}$$

wherein: R is an alkylphenol group where the alkyl group has 9–24 carbon atoms; and x is an integer from 6–10.0; and the balance of said clear stable motor fuel composition is gasoline.

10. A clear stable motor fuel composition of the "water-in-petroleum" type microemulsion in which the average particle diameter of the dispersed phase is about 0.1 micron or smaller, said motor fuel composition comprising a mixture based on the final motor fuel composition of: about 4.7 vol. % of tertiary butyl alcohol and/or 4.7 vol. % of isopropanol; about 0.1–0.5 wt. % of water; about 0.10 to 3.0 wt. % of a nonionic adduct of alkylphenol and ethylene oxide surfactant having structural Formula I, as follows:

$$R(CH_2CH_2O)_xH \quad \text{I}$$

wherein: R is an alkylphenol group where the alkyl group has 9–24 carbon atoms; and x is an integer from 6–10.0; and the balance of said clear stable motor fuel composition is gasoline.

11. A process for producing a clear stable motor fuel composition of the "water-in-petroleum" type microemulsion in which the average particle diameter of the dispersed phase is about 0.1 micron or smaller, said motor fuel composition comprising mixing together in an amount based on the final motor fuel composition the following ingredients to form a microemulsion: an alcohol selected from the group consisting of methanol in the amount of about 2.0 to 5.0 vol. %, ethanol in the amount of about 2.0 to 10.0 vol. %, and mixtures thereof in the amount of about 3.0 to 9.0 vol. %; about 2.0 to 10 vol. %, of a cosolvent alcohol selected from the group consisting of tertiary butyl alcohol, isopropanol, and mixtures thereof; water to provide a total water concentration of about 0.1 to 0.5 wt. %; about 0.10 to 3.0 wt. % of an adduct of alkylphenol and ethylene oxide surfactant having the structural Formula I, as follows:

$$R(CH_2CH_2O)_xH \quad \text{I}$$

wherein: R is an alkylphenol group where the alkyl group has 9–24 carbon atoms; and x is an integer from 6–10.0; and the balance of said clear stable motor fuel composition is gasoline.

12. The process of claim 11 wherein at least a portion of said water is provided dissolved in said gasoline and/or alcohol.

13. The process of claim 11 wherein the volume ratio of tertiary butyl alcohol and/or isopropanol to methanol and/or ethanol is in the range of about 0.3 to 3.0.

14. A process for producing upgraded clear stable motor fuel for an internal combustion engine from a hazy mixture of gasoline-alcohol-water comprising, mixing with said hazy gasoline-alcohol-water mixture to form a clear microemulsion a nonionic adduct of alkylphenol and ethylene oxide surfactant having the structural Formula I, as follows:

$$R(CH_2CH_2O)_xH \quad \text{I}$$

wherein: R is an alkylphenol group where the alkyl group has 9–24 carbon atoms; and x is an integer from 6–10.0; and wherein said clear stable motor fuel comprises a mixture based on the final motor fuel composition of about 2.0 to 10.0 volume percent of an alcohol selected from the group consisting of methanol, ethanol, tertiary butyl alcohol, isopropanol, and mixtures thereof; about 0.10 to 0.50 weight percent water; about 0.10 to 3.0 weight percent of said surfactant having said structural Formula I; and the remainder of said clear stable motor fuel substantially comprises gasoline.

15. The process of claim 14 wherein said motor fuel is a microemulsion of the "water-in-petroleum" type in which the average particle diameter of the dispersed phase is about 0.1 micron or smaller.

16. A process for producing upgraded clear stable motor fuel for an internal combustion engine from a hazy mixture of gasoline-alcohol-water comprising, mixing with said hazy gasoline-alcohol-water mixture to form a clear microemulsion a nonionic adduct of alkylphenol and ethylene oxide surfactant having the structural Formula I, as follows:

$$R(CH_2CH_2O)_xH \qquad I$$

wherein: R is an alkylphenol group where the alkyl group has 9–24 carbon atoms; and x is an integer from 6–10.0; and wherein said clear stable motor fuel comprises a mixture based on the final motor fuel composition of alcohol selected from the group consisting of methanol in the amount of about 2.0 to 5.0 vol. %, ethanol in the amount of about 2.0 to 10.0, vol. %, and mixtures thereof in the amount of about 3 to 9.0 vol. %; about 2.0 to 10 vol. % of a cosolvent alcohol selected from the group consisting of tertiary butyl alcohol, isopropanol, and mixtures thereof, wherein the volumetric ratio of tertiary butyl alcohol and/or isopropanol to methanol and/or ethanol is in the range of about 0.30 to 3.0; water to provide a total water concentration of about 0.1 to 0.5 wt. %; and about 0.10 to 3.0 wt. % of said surfactant represented by Formula I; and the remainder of said clear stable motor fuel substantially comprises gasoline.

17. A method for operating an internal combustion engine which comprises, supplying thereto and combusting therein a clear stable gasoline-alcohol-water motor fuel composition of the "water-in-petroleum" type microemulsion in which the average particle diameter of the dispersed phase is about 0.1 micron or smaller, said motor fuel composition comprising a mixture based on the final motor fuel composition of about 2.0 to 10.0 volume percent of an alcohol selected from the group consisting of methanol, ethanol, tertiary butyl alcohol, isopropanol, and mixtures thereof; about 0.10 to 0.50 weight percent water; about 0.10 to 3.0 weight percent of a nonionic adduct of alkylphenol and ethylene oxide surfactant having the structural Formula I, as follows:

$$R(CH_2CH_2O)_xH \qquad I$$

wherein: R is an alkylphenol group where the alkyl group has 9–24 carbon atoms; and x is an integer from 6–10.0; and the balance of said clear stable motor fuel composition comprises gasoline.

* * * * *

UNITED STATES PATENT AND TRADEMARK OFFICE

CERTIFICATE OF CORRECTION

PATENT NO. : 4,599,088

DATED : 7/8/86

INVENTOR(S) : Marshall E. Davis and Rodney Lu-Dai Sung

It is certified that error appears in the above—identified patent and that said Letters Patent is hereby corrected as shown below:

column 5, line 54, delete "atoms and x is an integer from 7-8."

Signed and Sealed this

Twentieth Day of January, 1987

*Attest:*

DONALD J. QUIGG

*Attesting Officer*

*Commissioner of Patents and Trademarks*